US006938818B2

(12) United States Patent
Moorman et al.

(10) Patent No.: US 6,938,818 B2
(45) Date of Patent: Sep. 6, 2005

(54) MINOR-END LOADING CARTON

(75) Inventors: Stephen E. Moorman, Madera, CA (US); Anthony Fulton, Aurora, CO (US)

(73) Assignee: Georgia-Pacific Corporation, Atlanta, GA (US)

( * ) Notice: Subject to any disclaimer, the term of this patent is extended or adjusted under 35 U.S.C. 154(b) by 76 days.

(21) Appl. No.: 10/628,571

(22) Filed: Jul. 29, 2003

(65) Prior Publication Data

US 2005/0023332 A1 Feb. 3, 2005

(51) Int. Cl.[7] ..... B65D 5/10

(52) U.S. Cl. ..... 229/122; 229/120; 229/156; 229/157

(58) Field of Search ..... 229/120, 122, 229/155, 156, 157, 185; 426/106, 118

(56) References Cited

U.S. PATENT DOCUMENTS

| | | | | | |
|---|---|---|---|---|---|
| 490,167 | A | * | 1/1893 | Schmidt | 229/157 |
| 2,398,797 | A | * | 4/1946 | Meyer et al. | 229/122 |
| 2,970,741 | A | * | 2/1961 | Stone et al. | 229/157 |
| 2,973,129 | A | * | 2/1961 | Stone et al. | 229/157 |
| 3,081,017 | A | | 3/1963 | Gerbino | |
| 3,660,116 | A | * | 5/1972 | Clark | 229/120 |
| 3,695,505 | A | | 10/1972 | Wolf | |
| 3,863,829 | A | | 2/1975 | Merrill | |
| 3,892,346 | A | | 7/1975 | Hughes et al. | |
| 4,105,152 | A | * | 8/1978 | Elward | 229/120 |
| 4,238,068 | A | | 12/1980 | Ellerbe et al. | |
| 4,353,495 | A | | 10/1982 | Jes | |
| 4,389,013 | A | | 6/1983 | Hall et al. | |
| 4,529,117 | A | | 7/1985 | Brundage | |
| 4,565,316 | A | * | 1/1986 | Jes | 229/122 |
| 4,821,949 | A | | 4/1989 | Booth | |
| 4,884,741 | A | | 12/1989 | Nederveld | |
| 4,953,782 | A | | 9/1990 | Noland | |
| 5,046,662 | A | | 9/1991 | Cowles | |
| 5,104,035 | A | | 4/1992 | Rosenbaum, II | |
| 5,163,609 | A | | 11/1992 | Muise, Jr. | |
| 5,181,651 | A | | 1/1993 | Oppenheim | |
| 5,263,612 | A | | 11/1993 | Nederveld | |
| 5,305,950 | A | | 4/1994 | Oppenheim | |
| 5,318,220 | A | | 6/1994 | Gagliardo | |
| 5,421,138 | A | | 6/1995 | Muise et al. | |
| 5,503,324 | A | * | 4/1996 | Bacchetti et al. | 229/120 |
| 5,619,841 | A | | 4/1997 | Muise et al. | |
| 5,642,854 | A | | 7/1997 | Hatton | |
| 5,775,575 | A | | 7/1998 | Dorman et al. | |
| 5,839,651 | A | | 11/1998 | Teags et al. | |
| 5,921,465 | A | | 7/1999 | Garton | |
| 6,102,279 | A | | 8/2000 | Dowd | |
| 6,102,280 | A | | 8/2000 | Dowd | |
| 6,257,484 | B1 | | 7/2001 | Dowd | |
| 6,349,876 | B1 | | 2/2002 | Dowd | |
| 6,386,437 | B1 | | 5/2002 | Larson, Jr. | |
| 6,740,346 | B2 | * | 5/2004 | Shapiro | 426/124 |
| 2002/0011513 | A1 | | 1/2002 | Dowd | |
| 2002/0130167 | A1 | * | 9/2002 | Riedi | 229/120 |

* cited by examiner

*Primary Examiner*—Gary E. Elkins
(74) *Attorney, Agent, or Firm*—Banner & Witcoff, Ltd.

(57) ABSTRACT

A minor-end loading carton is provided that includes a bottom panel opposing a top panel, and a second pair of opposing panels connecting the bottom panel to the top panel to form a rectangular body having a first minor end and a second minor end. The minor ends may be closable via a plurality of flaps foldably connected to the panels. A method is further provided for loading and shipping elongate materials in a minor-end loading carton. According to one embodiment of the invention, the method includes loading the products downward through a second minor end of a minor-end loading carton against the inside of the closed first minor end while the first minor end is substantially horizontal. The products may include elongate materials, such as stalk produce, which are preferably oriented parallel to the minor ends extending from a first panel to a second panel.

24 Claims, 10 Drawing Sheets

MINOR-END LOADING CARTON

TECHNICAL FIELD

This invention relates generally to a minor-end loading carton. More particularly, the invention concerns a minor-end loading carton for storing and transporting elongate items, such as stalk produce, and to a method for loading and shipping the same.

BACKGROUND

Different types of cartons and shipping containers exist for a variety of different products and purposes. Shipping containers for various elongate products are known, and include containers for stalk produce. Conventional containers for stalk produce, such as celery, include rectangular cartons having gapped bottoms formed from folded flaps. The bottom flaps are often gapped as an economy measure to conserve carton material. The bottom flaps are typically secured in a folded configuration using metal stitches or staples. Such conventional containers are generally time-consuming to erect from folded blanks, due in part to the time involved with installing the metal staples.

Further, conventional containers for elongate materials, such as stalk produce, typically are designed to be loaded from a major end. For example, a rectangular corrugated paperboard carton for stalk produce often includes flaps at its major ends that are folded and secured for shipping. The major ends are generally larger than the remaining sidewalls. Because the major ends cover a larger area, any pressure applied to the inside of the carton conveys a larger force to the major ends than the smaller sidewalls. As such, when overpacked these major end flaps often disengage, which can permit the contents to spill. This is particularly prevalent during shipping and handling of the overpacked cartons. Using metal stitches to secure the major flaps can exacerbate the problem, as these stitches often pop-out when overpacked.

Because time spent assembling empty cartons and sealing filled cartons is time lost from the loading process, it is important to reduce time spent on such processes. Further, time spent cleaning-up spilled products and the loss of spilled materials themselves can be expensive. Many conventional cartons require time-consuming steps to initially assemble the carton, as well as to seal the filled cartons. Further, conventional elongate-materials containers, which are typically loaded through their major ends, often fail during shipping and handling. Accordingly, a need exists for an improved elongate-materials shipping container and method for loading and shipping the elongate materials.

SUMMARY

In order to overcome the above-described problems and other problems that will become apparent when reading this specification, aspects of the present invention provide a minor-end loading carton. A minor-end loading carton according to one embodiment of the invention generally includes a bottom panel opposing a top panel, and a second pair of opposing panels connecting the bottom panel to the top panel to form a rectangular body having a first minor end and a second minor end. The minor ends may be closable via a plurality of flaps foldably connected to the panels. For example, a first minor end may include a substantially uninterrupted first flap, a second flap having a slot formed therein, a third flap having a slot formed therein, and a fourth flap having a pair of tabs. In a closed configuration, the tabs of the fourth flap engage the slots of the second and third flaps, and the first flap abuts the second and third flaps, but is detached from them.

Aspects of the present invention further provide a method for loading and shipping elongate materials in a minor-end loading carton. According to one embodiment of the invention, the method includes loading the products downward through a second minor end of a minor-end loading carton against the inside of a closed first minor end while the first minor end is substantially horizontal. The products may include elongate materials, such as stalk produce, which are preferably oriented parallel to the minor ends and extend from a first panel to a second panel. For instance, celery may be loaded through the second minor end and laid against the first minor end extending from the first panel to the second panel.

The method further includes closing the second minor end and rotating the carton such that the first panel is substantially horizontal and the minor ends are substantially vertical. As such, the elongate materials are in a substantially vertical configuration within the closed carton for shipping and storage. Other features and advantages of various aspects of the invention will become apparent with reference to the following detailed description and figures.

BRIEF DESCRIPTION OF THE DRAWINGS

The invention will be described in detail in the following description of preferred embodiments with reference to the following figures wherein.

DETAILED DESCRIPTION OF THE FIGURES

Figure 1:
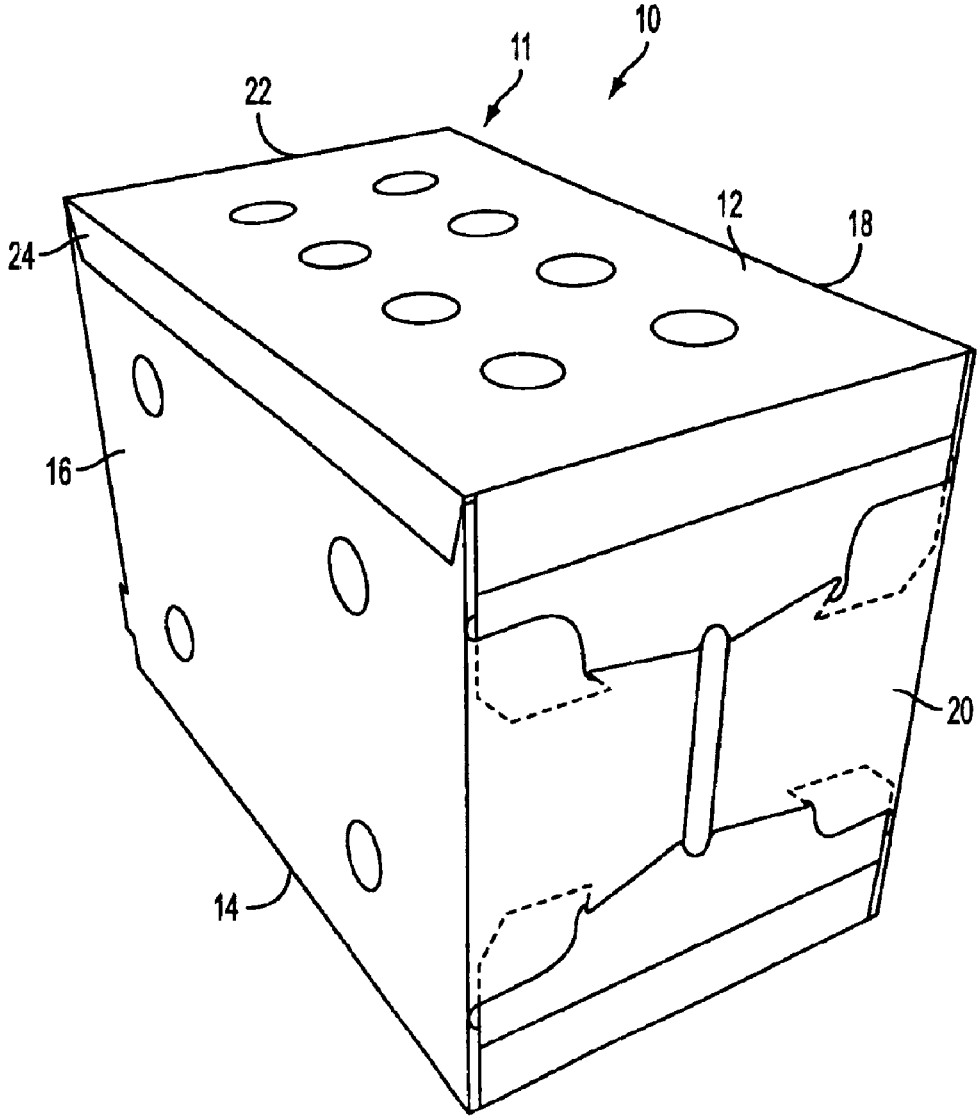
FIG. 1 is a perspective view of a minor-end loading carton according to an embodiment of the invention showing a fill minor end in a locked configuration.

The various aspects of the invention may be embodied in various forms. The following description of the figures shows by way of illustration various embodiments in which aspects of the invention may be practiced. It is to be understood that other embodiments may be utilized and structural and functional modifications may be made without departing from the scope of the present invention. Referring now to FIGS. 1–4 and 7, a minor-end loading carton 10 according to an embodiment of the invention is shown. As shown, carton 10 generally includes a top panel 12 opposing a bottom panel 14, and a pair of opposing side panels 16 and 18 connecting top panel 12 to bottom panel 14. The panels 12, 14, 16 and 18 together form a substantially rectangular hollow body 11 having a base minor end 20 opposing a fill minor end 22.

Figure 2:
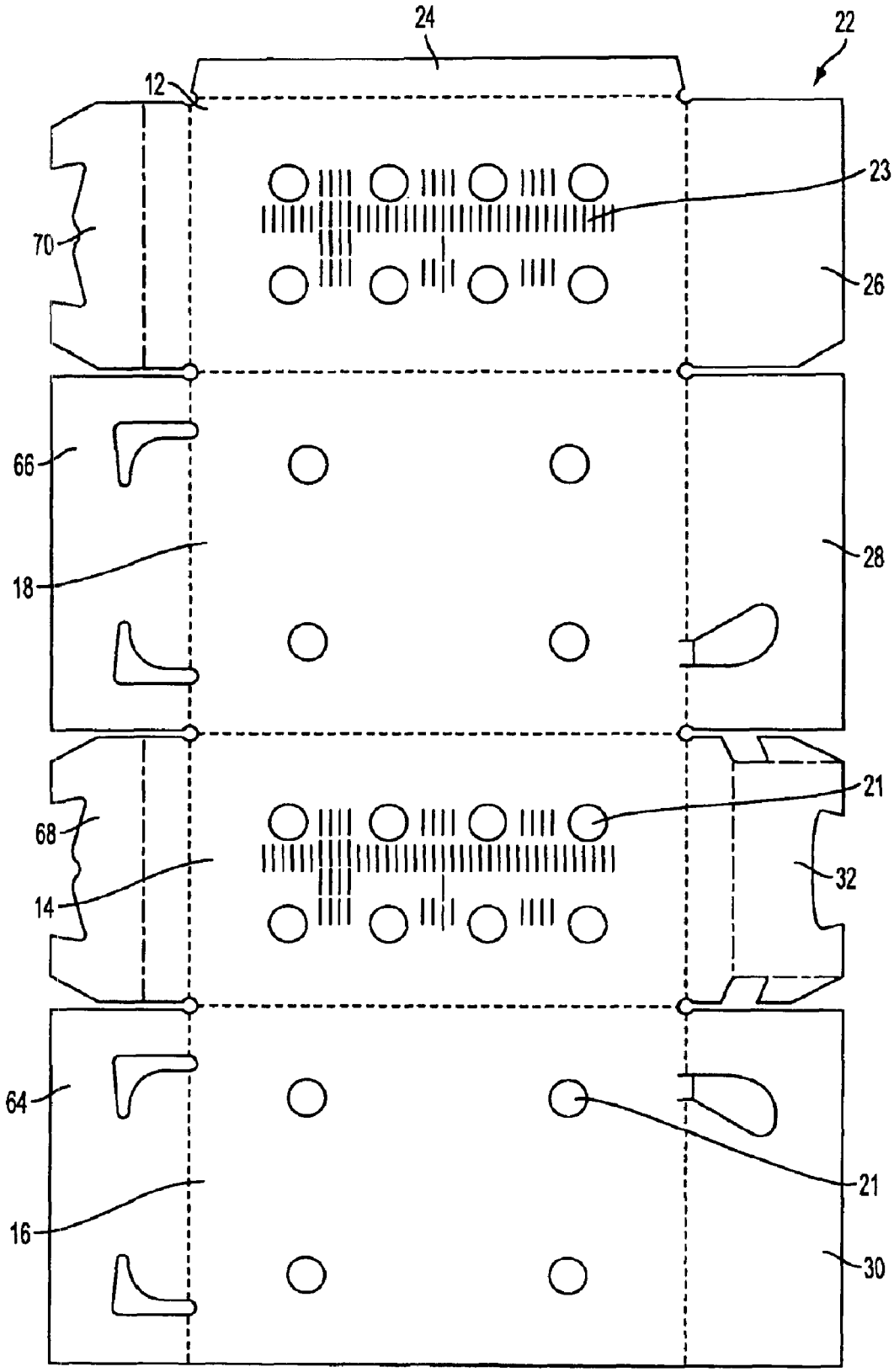
FIG. 2 is plan view of a carton blank corresponding to the carton of FIG. 1.

Carton 10 may be formed from a carton blank 22, such as shown in FIG. 2. Carton blank 22 may include a unitary corrugated paperboard blank that is suitably cut, scored, perforated, etc. to be folded into carton 10. It is understood that other suitable materials, such as corrugated plastic, may also be used for blank 22. To form carton 10, an attachment tab 24 is attached to side panel 16 via suitable means, such as an adhesive or metal stitches (not shown). In this configuration, a flattened carton (not shown) may be formed. The flattened carton (not shown) occupies minimal space and is particularly suited for shipping bundles of cartons. Carton 10 may be formed by unfolding the flattened carton (not shown) to form a hollow rectangular body 11. As shown, blank 22 and thus carton 10 may include holes 21 to permit washing of products, such as produce stored in carton 10, and/or to provide ventilation to stored products. Further, blank 22 may be knurled to include ribs 23 for reducing movement of carton 10 during transit.

Figure 3:
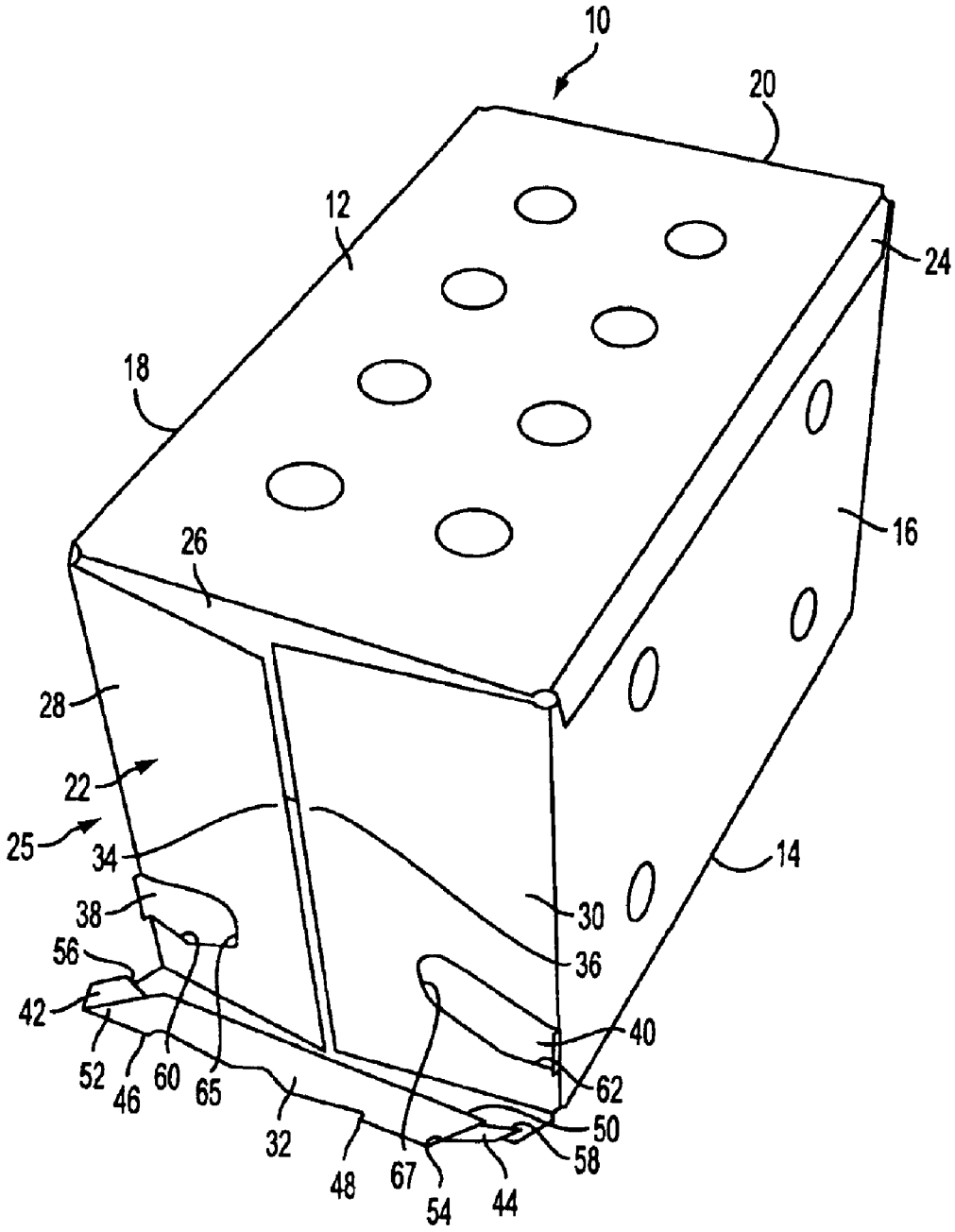
FIG. 3 is a perspective view of the carton of FIG. 1 showing a base minor end in an unlocked configuration according to one embodiment for folding and locking the base minor end.
Figure 4:
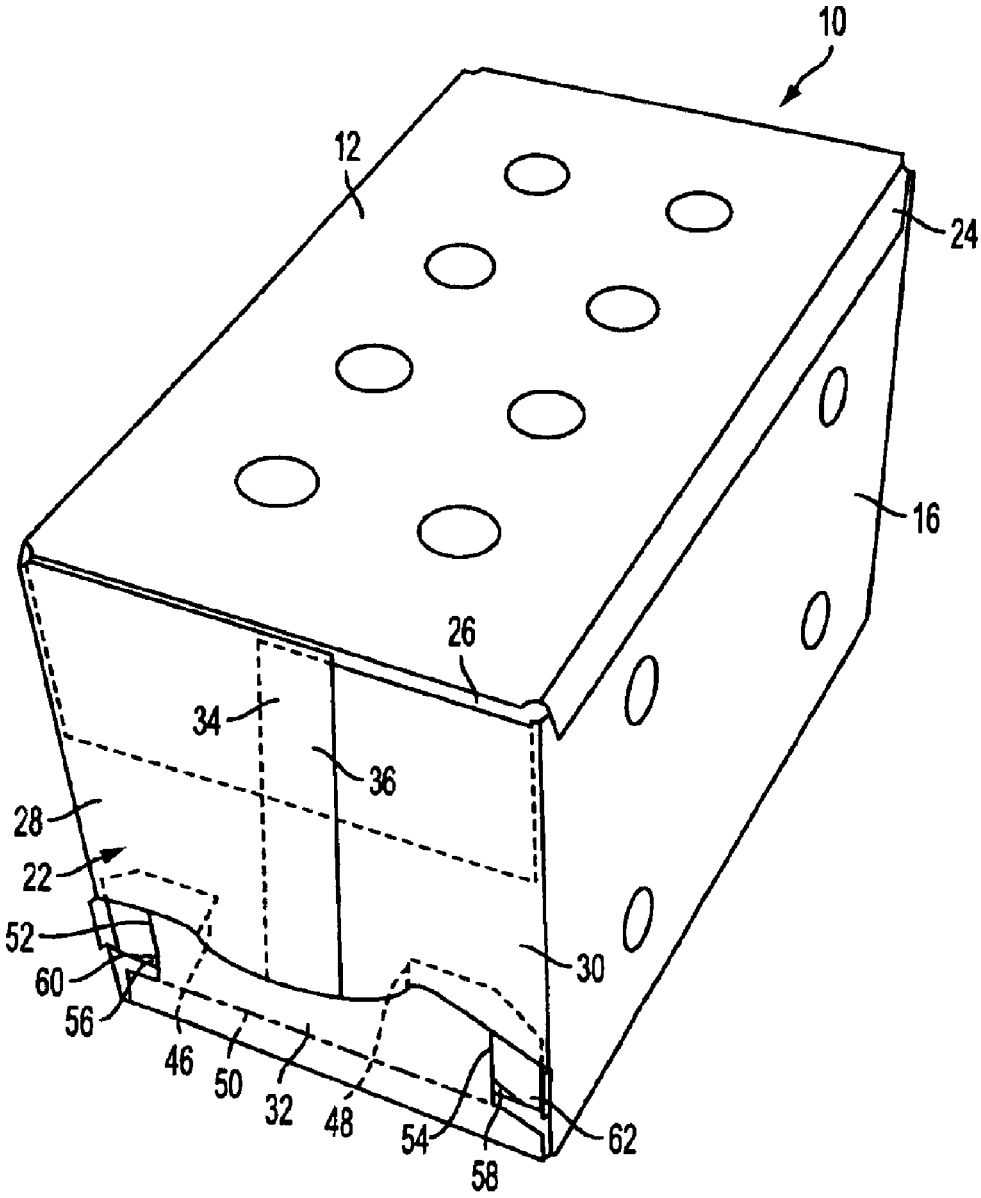
FIG. 4 is a perspective view of the carton of FIG. 1 showing the base minor end in a locked configuration according to the folding and locking embodiment of FIG. 3.

As shown in FIG. 3, the hollow rectangular configuration of carton 10 may be retained by engaging self-locking closure features 25 at base minor end 22. The base minor end self-locking features 25 permit a person to quickly and easily close base minor end 22, and thereby to promptly set up carton 10 for loading without using staples or other locking devices. As shown in FIGS. 3 and 4, the base minor end self-locking features 25 include flaps foldably attached to ends of panels 12, 14, 16 and 18. The flaps include a non-locking flap 24 foldably attached to top panel 12, a left slot flap 28 foldably attached to side panel 18, a right slot flap 30 foldably attached to side panel 16, and a locking flap 32 foldably attached to bottom panel 14. Each of the flaps is foldable between an open position and a closed position substantially perpendicular to the respective panel to which it is foldably attached. In their closed positions, the flaps act in concert to close base minor end 22 and to retain carton 10 in a rectangular configuration for loading.

In the closed configuration according to one embodiment for folding base minor end 22, non-locking flap 26 is disposed inside of flaps 28, 30 and 32. Non-locking flap 26 abuts flaps 28 and 30, but does not engage them and is disconnected from them in the closed configuration. As such, flap 26 is preferably uninterrupted. Left slot flap 28 and right slot flap 30 are disposed outside of non-locking flap 26 in the closed configuration, and partially overlap non-locking flap 26 in the closed configuration. Preferably, the distal portions 34 and 36 of flaps 28 and 30 respectively overlap each other in the closed configuration. Formed within each of left slot flap 28 and right slot flap 30 respectively is a slot 38 and 40. Locking flap 32 includes a pair of tabs 42 and 44 at its distal corners that engage slots 38 and 40 in the closed configuration. Locking flap 32 also includes a pair of forward hooks 46 and 48 for further engaging slots 38 and 40.

Together flaps 26, 28, 30 and 32 provide self-locking features 25 that allow a person to quickly and securely close base minor end 22. To close base minor end 22, a person may first fold non-locking flap 26 into the closed position shown in FIG. 3, and then fold left slot flap 28 and right slot flap 30 in any order into their closed position shown in FIG. 4. The closed positions of flaps 26, 28 and 30 may be locked by simultaneously folding locking flap 32 into its closed position shown in FIG. 4 while placing tabs 42 and 44 through slots 38 and 40. Locking flap 32 may include a fold line 50 to assist placing tabs 42 and 44 through slots 38 and 40, such as by sliding tabs 42 and 44 at an angle through slots 38 and 40. Locking flap 32 may also include tab fold lines 52 and 54 to allow tabs 42 and 44 to be folded for further assisting placement of the tabs through the slots. Fold lines 50, 52 and 54 may include creases, perforations, relief cuts, etc. that guide folding in a desired location on carton 10.

Because the procedure for placing base minor 22 in the closed and locked configuration simply requires folding flaps 26, 28, 30 and 32 into their closed positions, and engaging locking flap 32 with slot flaps 28 and 30, a person may quickly and easily configure carton 10 for loading. The lack of a step to connect non-locking flap 26 with other flaps keeps the process of closing base minor end 22 simple, and yet the fold configuration provides sufficient closure support. In this closed configuration, flaps 26, 28, 30 and 32 interact to keep base minor end 22 closed. Left and right slot flaps 28 and 30 at least partially overlap non-locking flap 26 and thereby keep it in its closed position. Overlapping distal portions 34 and 36 of left and right slot flaps 28 and 30 further assist in keeping non-locking flap 26 in its closed position, as well as keeping left and right slot flaps 28 and 30 in their closed positions. Locking flap 32 overlaps flaps 28 and 30 to further keep them in their closed positions.

For improved locking of base minor end 22 in the closed configuration, tabs 42 and 44 of locking flap 32 each include a tab hook 56 and 58 for hooking a lower edge 60 and 62 respectively of slots 38 and 40. Tab hooks 56 and 58 engage slot edges 60 and 62 to keep tabs 42 and 44 disposed in slots 38 and 40. Further, forward hooks 46 and 48 engage inner edges 65 and 67 respectively of slots 38 and 40 to keep flaps 28 and 30 disposed in their closed positions. For example, tab hooks 56 and 58 may prevent locking flap 32, and thus tabs 42 and 44, from sliding downward out of slots 38 and 40. Also, forward hooks 46 and 48 may be angled inward to keep flaps 28 and 30 from moving apart, such as when rotating out of their closed position. Retention of flaps 26, 28, 30 and 32 in their closed configuration is further assisted by products stored within carton 10 pressing against tabs 42 and 44, which helps to keep them engaged in slots 38 and 40.

Figure 7:
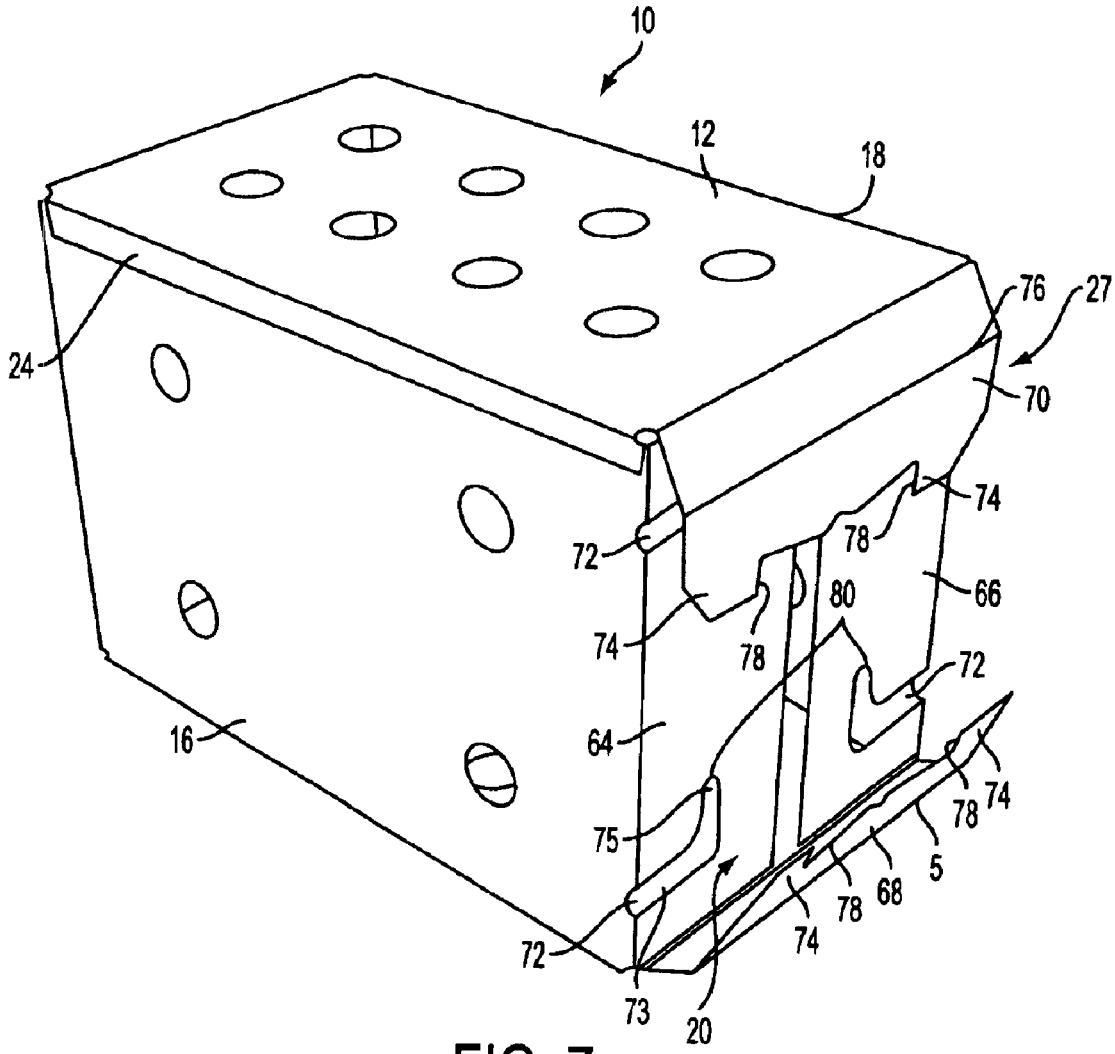
FIG. 7 is a perspective view of the carton of FIG. 1 showing the fill minor end in an unlocked configuration.

Fill minor end 20 may be closed via self-locking features 27 as shown in FIG. 7, which include left slot flap 64, right slot flap 66, lower tab flap 68 and upper tab flap 70. Each of flaps 64, 66, 68 and 70 is foldably attached to distal ends of panels 12, 14, 16 and 18. Each of flaps 64, 66, 68 and 70 is foldable between an open position and a closed position substantially perpendicular to the respective panel to which it is foldably attached. In their closed positions, the flaps act in concert to close fill minor end 20 and thereby retain loaded products within carton 10.

As shown in FIG. 7, left and right slot flaps 64 and 66 each includes a pair of substantially L-shaped slots 72. The L-shaped slots 72 are oriented such that one leg 73 of each slot is substantially parallel to panels 12 and 14, and the other leg 75 of each slot is substantially parallel to panels 16 and 18. Upper tab flap 70 and lower tab flap 68 each includes a pair of tabs 74 for engaging respective ones of L-shaped slots 72. To assist engagement of tabs 74 into slots 72, upper and lower tab flaps 70 and 68 each include a fold line 76. Fold line 76 may include a crease, perforation, score, etc. that guides folding of flaps 68 and 70 during engagement with flaps 64 and 66. Each tab 74 includes a tab hook 78, which engages leg 75 of a respective L-shaped slot 72 for retaining flaps 64, 66, 68 and 70 in their closed configuration. To further assist retention of engaged tabs 74, leg 75 may be angled outward (not shown) toward panels 16 and 18 respectively.

The process for closing fill minor end 20 includes initially folding left and right slot flaps 64 and 66 into their closed positions. In their closed positions, each flap 64 and 66 is oriented substantially perpendicular to the panel 16 and 18 to which it is respectively attached. Lower tab flap 68 and upper tab flap 70 may then be slidingly folded to guide tabs 74 through respective slots 72 until flaps 68, 70 are extended and tab hooks 78 engage a respective end portion 80 of L-shaped slots 72. Hooking end portions 80 with tab hooks 78 prevents inner flaps 64 and 66 from moving out of their closed positions. The L-shape of the slots 72 prevent tabs 74 of flaps 68 and 70 from popping out of slots 72. This is further assisted by pressure from products stored within carton 10 applied against portions of tabs 74 that extend into carton 10.

Figure 5:
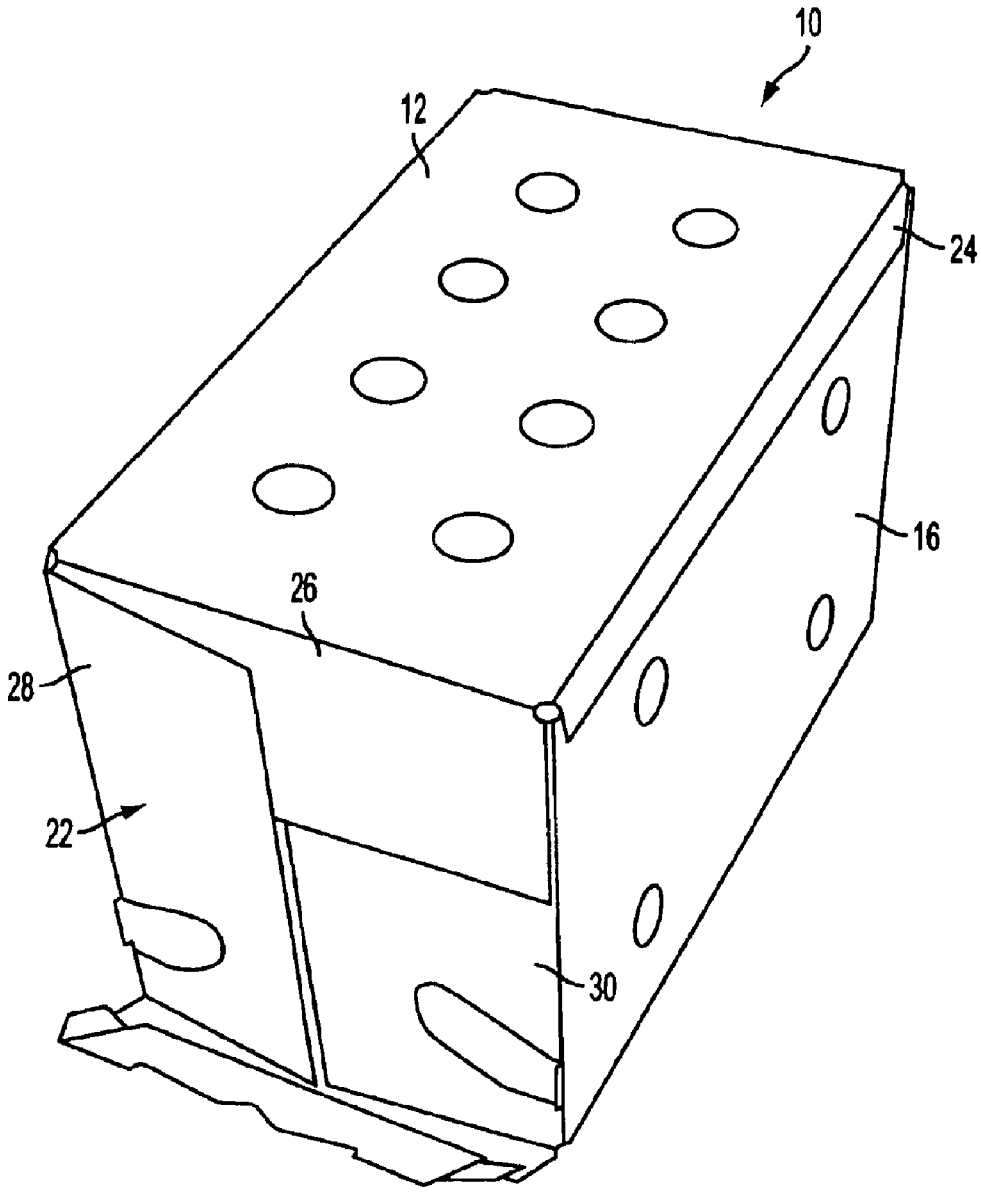
FIG. 5 is a perspective view of the carton of FIG. 1 showing the base minor end in an unlocked configuration according to another embodiment for folding and locking the bottom minor end.
Figure 6:
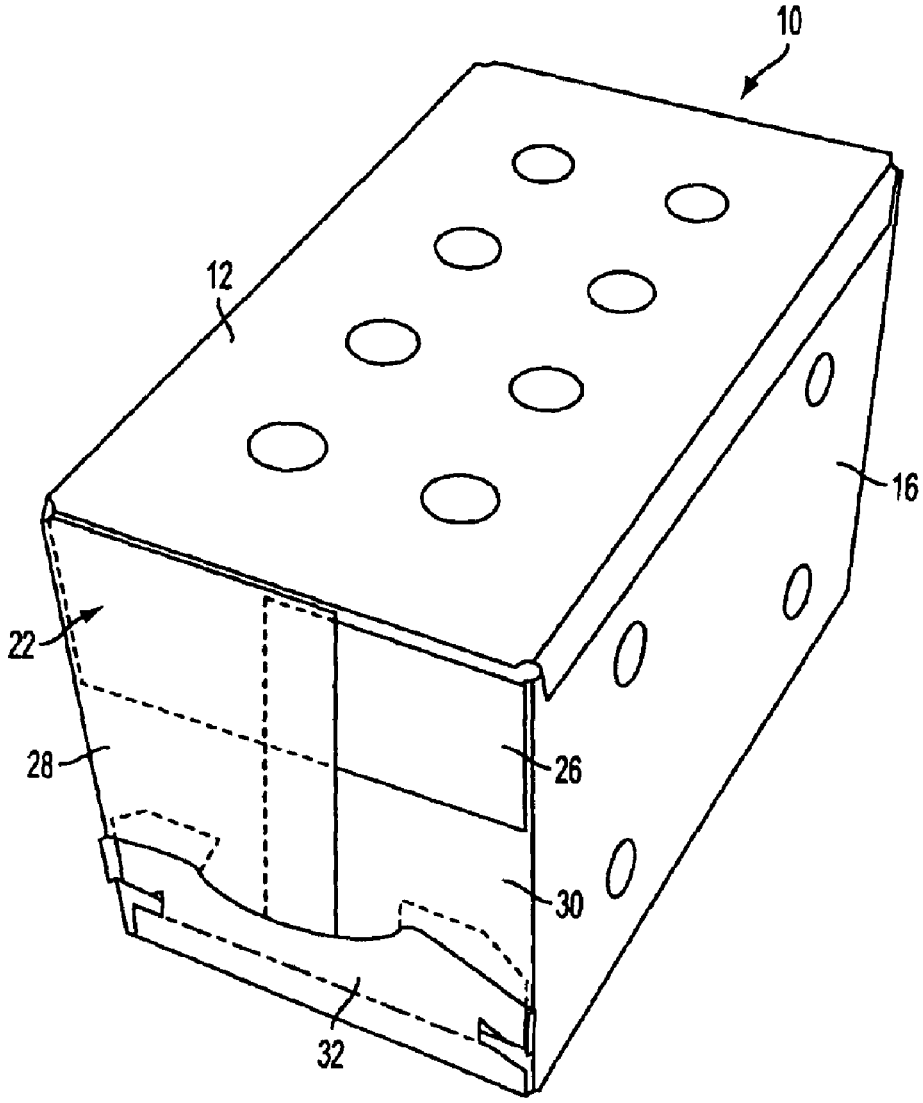
FIG. 6 is a perspective view of the carton of FIG. 1 showing the base minor end in a locked configuration according to the folding and locking embodiment of FIG. 5.

Referring now to FIGS. 5–6 along with FIGS. 1, 2 and 7, carton 10 folded according to another embodiment of the invention is shown. This embodiment includes the structure of the previous embodiment along with a different way of folding carton 10. In particular, the closed configuration of base minor end 22 differs from the previous embodiment. In this embodiment, right slot flap 30 is disposed inside of non-locking flap 26, and left slot flap 28 is disposed outside of flap 26 while base minor end 22 is in the closed configuration. As with the previous embodiment, non-locking flap 26 abuts flaps 28 and 30, but does not engage and is disconnected from them in the closed configuration. As such, flap 26 is preferably uninterrupted. Further, the distal portions 34 and 36 of flaps 28 and 30 preferably overlap each other in the closed configuration.

To close base minor end 22, a person may first fold right slot flap 30 into the closed position shown in FIG. 5, then fold non-locking flap 26 into its closed position, and next fold left slot flap 28 into its closed position shown in FIG. 5. As with the previous embodiment, the closed positions of flaps 26, 28 and 30 may be locked by simultaneously folding locking flap 32 into its closed position shown in FIG. 6 while placing tabs 42 and 44 through slots 38 and 40. In a further embodiment, the fold order and positions of left slot 28 and right slot 30 may be reversed.

In the closed configuration shown in FIG. 6, flaps 26, 28, 30 and 32 interact to keep base minor end 22 closed. Left slot flap 28 at least partially overlaps non-locking flap 26 to keep it in the closed position, which also overlaps right slot flap 30. Overlapping distal portions 34 and 36 of left and right slot flaps 28 and 30 further assists with retaining flaps 26, 28 and 30 in their closed positions. Locking flap 32 overlaps flaps 28 and 30 to further keep them in their closed positions. As with the previous embodiment, tabs 42 and 44 and tab hooks 56 and 58 of locking flap 32 act to lock the flaps in their closed positions.

Figure 8:
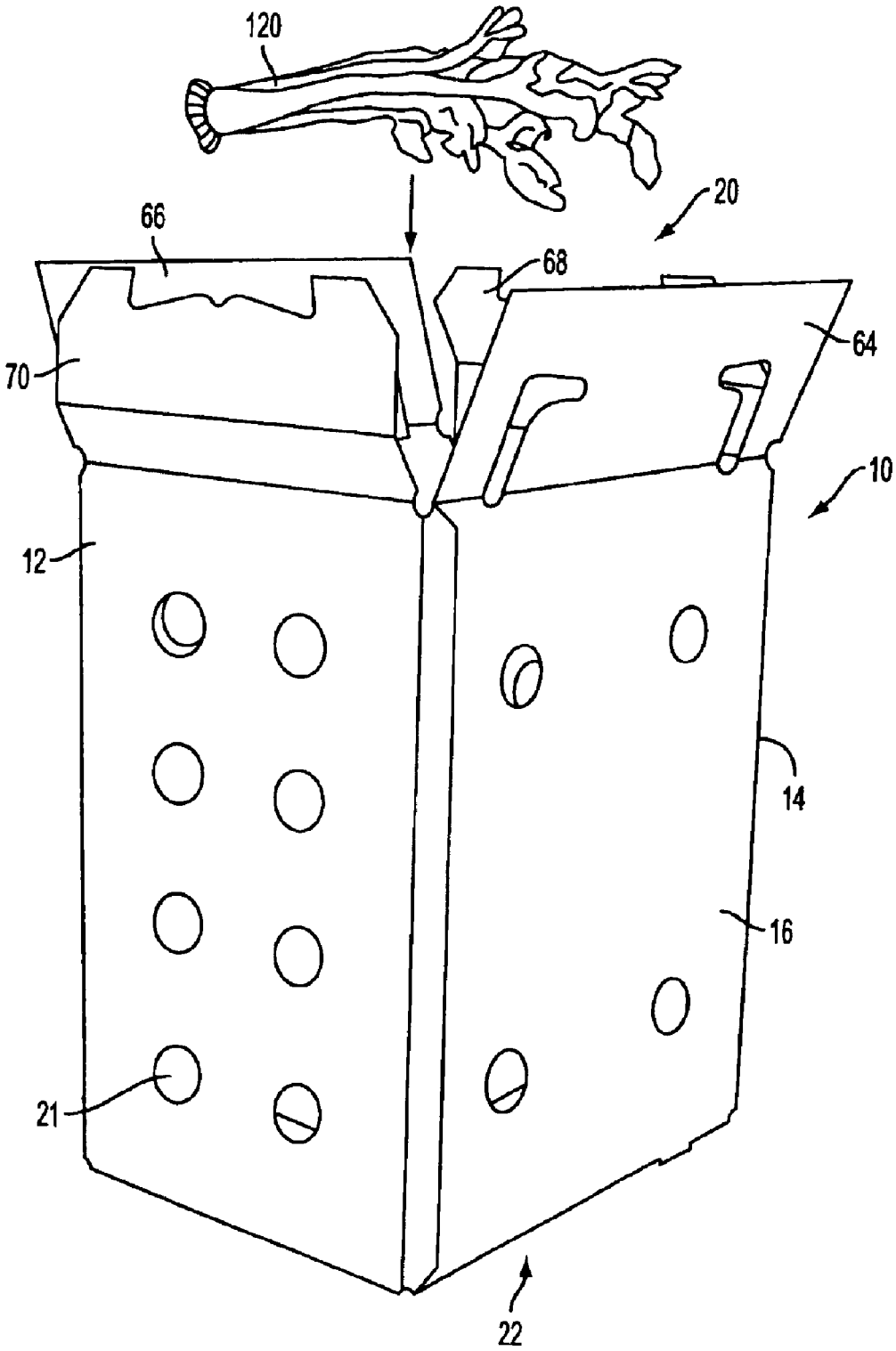
FIG. 8 is a perspective view of the carton of FIG. 1 rotated ninety degrees with the fill minor end opened to provide loading of products therethrough.
Figure 9:
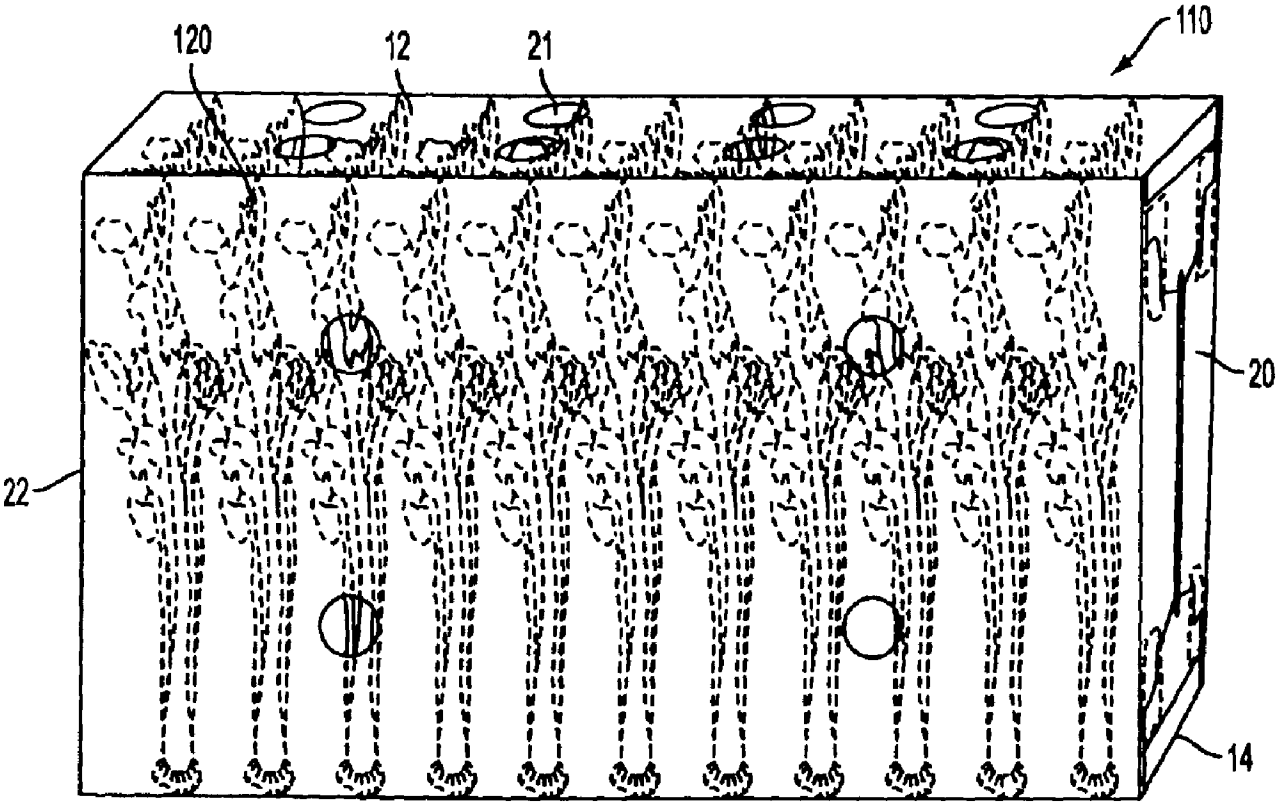
FIG. 9 is a perspective view of a stalk produce shipping carton according to an embodiment of the present invention shown loaded with celery.
Figure 10:
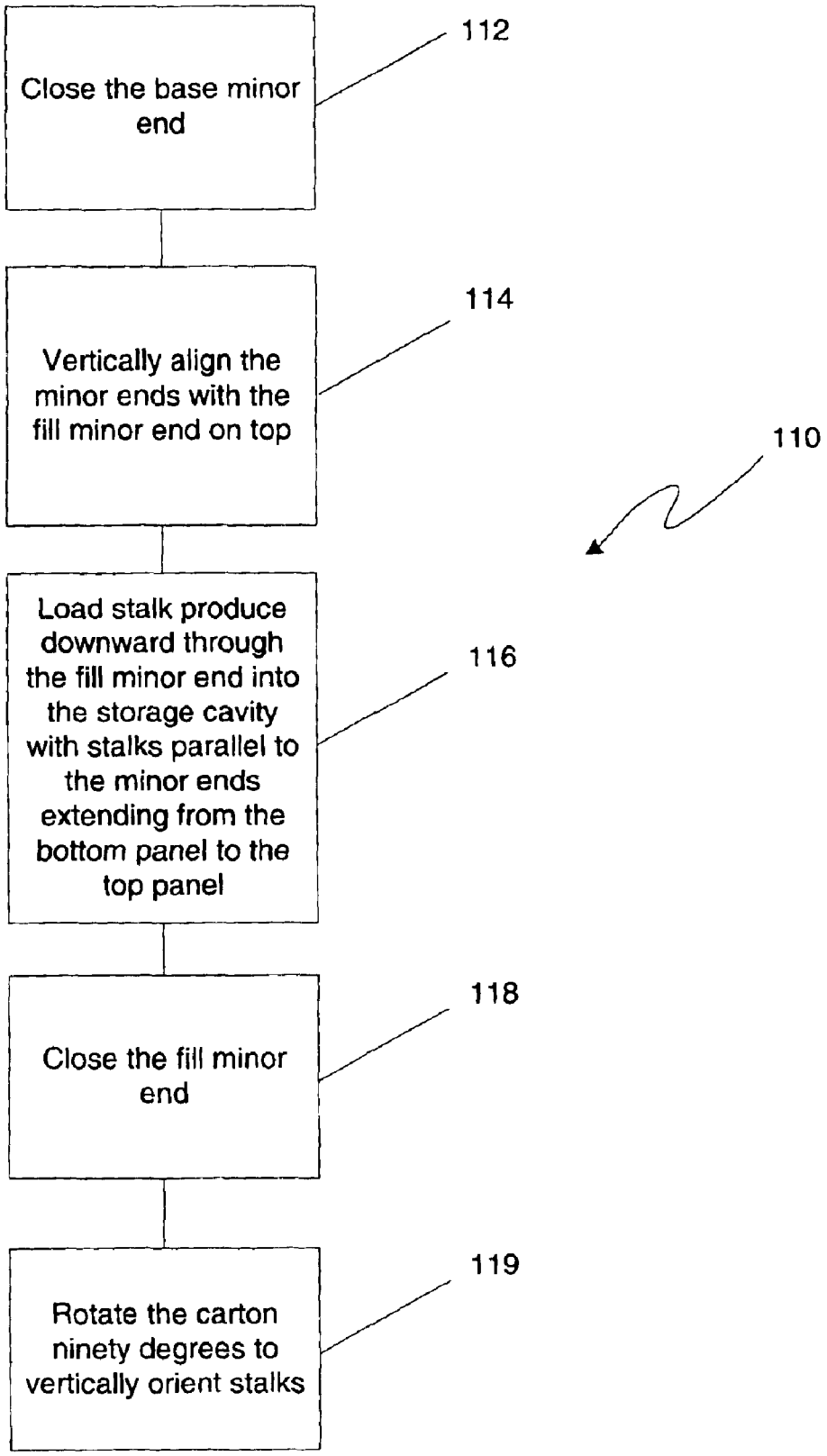
FIG. 10 illustrates a method for loading and shipping a minor-end loading carton according to an embodiment of the invention.

Referring now to FIGS. 8–10, a method 110 for loading and shipping elongate materials, such as stalk produce, in a minor-end loading carton 10 is generally shown. Using minor-end loading carton 10 as an example, carton 10 is formed as discussed above by closing 112 the base minor end 22 via engaging flaps at base minor end 22 in a closed configuration, and orienting 114 carton 10 in a loading configuration such that the minor ends 20 and 22 are substantially vertically aligned with each other. In the loading configuration, base minor end 22 preferably rests on a support surface (not shown) and fill minor end 20 is oriented upward as shown in FIG. 8. In such an orientation, elongate materials such as produce 120 are loaded 116 downward through fill minor end 20 into carton 10. The stalk produce 120, which may include celery, is oriented parallel to minor ends 20 and 22 extending from bottom panel 14 to top panel 12. When loaded, stalk produce 120 is laid against the inside of base minor end 20. After carton 10 is loaded, the carton is closed 118 by engaging the locking features on the fill minor-end 20 as discussed above.

For shipping purposes, loaded carton 110 is rotated 119 approximately ninety degrees from the loading configuration in the shipping configuration shown in FIG. 9. As such, base minor-end 22 and fill minor end 20 are substantially horizontally aligned, and bottom panel 14 and top panel 12 are oriented in a substantially horizontal configuration. In other words, loaded carton 110 is rotated approximately ninety degrees from the loading position shown in FIG. 8. This shipping orientation provides a number of advantages, particularly for elongated materials such as stalk produce. For example, if the stalk produce 120 (e.g., celery) is laid in the carton through fill minor end 20 such that the stalks are substantially parallel to the minor ends 20 and 22, carton 10 is rotated to place the stalks in the substantially vertical orientation for shipping shown in FIG. 9.

This orientation provides various advantages. For example, the vertical orientation of stalk produce 120 supplements the strength of the carton 10, particularly in the vertical direction. As such, filled cartons 110 may have sufficient strength for relatively tall stacks of cartons, such as pallet cartons. Further, in concert with holes 21 formed in carton 10, the vertical orientation of stalk produce 120 allows access and drainage for hydro-cooling of the stalk produce even when placed in such stacks.

Other advantages are also realized using carton 10. For example, stalk produce 120 applies less force against the closed ends than in other known cartons. For instance, as shown in FIG. 2, panels 12, 14, 16 and 18 may be formed from continuous blank material. Because stalk produce 120 is often over-packed in order to maximize shipping space, the overpack pressure exerts less force on smaller minor ends 20 and 22 than on the continuous panels 12, 14, 16 and 18. Thus, the potential for locked flaps to become unlocked is reduced, which prevents spillage and resultant product loss. Additionally, flaps on smaller minor ends 20 and 22 provide a blank design that requires less material than placing flaps on the larger major panels. Further, the self-locking design of the flaps 26, 28, 30 and 32, as well as flaps 64, 66, 68 and 70, eliminates the need for staples and other locking devices.

While the present invention has been described in connection with the illustrated embodiments, it will be appreciated and understood that modifications may be made without departing from the true spirit and scope of the invention. In particular, the invention applies to many different minor-end loading cartons of various shapes and designs. Additionally, the minor end flaps of the disclosed embodiments and other embodiments may be secured in different ways. Further, the invention applies to various shapes and types of elongate products including produce and non-produce products.

We claim:

1. A minor-end loading carton comprising:

a first pair of opposing panels;

a second pair of opposing panels connecting the first pair of panels to form a substantially rectangular hollow body having a pair of opposing minor ends, each of the panels being larger than the opposing minor ends;

a first flap foldably attached to a first one of the panels at a first one of the minor ends, the first flap being foldable between an open position and a closed position substantially perpendicular to the first panel;

a second flap having a slot formed therein foldably attached to a second one of the panels at the first minor end, the second flap being foldable between an open position and a closed position substantially perpendicular to the second panel;

a third flap having a slot formed therein foldably attached to a third one of the panels at the first minor end opposing the second flap, the third flap being foldable between an open position and a closed position substantially perpendicular to the third panel; and a fourth flap attached to a fourth one of the panels at the first minor end, the fourth flap being foldable between an open position and a closed position substantially perpendicular to the fourth panel, the fourth flap having a first tab for engaging the slot of the second flap and a second tab for engaging the slot of the third flap;

wherein, the second flap and the third flap each at least partially overlap the first flap in a closed configuration and are detached from the first flap in the closed configuration, and the fourth flap tabs engage respective slots of the second and third flaps in the closed configuration.

2. The minor-end loading carton of claim 1, wherein a distal portion of the second flap overlaps a distal portion of the opposing third flap in the closed configuration.

3. The minor-end loading carton of claim 1, wherein the second flap and the third flap at least partially overlap the first flap on the same side of the first flap in the closed configuration.

4. The minor-end loading carton of claim 1, wherein the second flap and the third flap at least partially overlap the first flap on opposite sides of the first flap in the closed configuration.

5. The minor-end loading carton of claim 1, wherein the tabs of the fourth flap each include a tab hook engaging an edge of a respective one of the slots of the second and third flaps in the closed configuration.

6. The minor-end loading carton of claim 1, wherein the tabs of the fourth flap are foldable with respect to the fourth flap for assisting engagement with the slots of the second and third flaps.

7. The minor-end loading carton of claim 6, wherein a distal portion of the fourth flap includes a pair of forward hooks, each one of the forward hooks engaging an edge of a respective one of the slots of the second and third flaps in the closed configuration.

8. The minor-end loading carton of claim 1, wherein the fourth flap includes a fold line assisting engagement with the slots of the second and third flaps.

9. The minor-end loading carton of claim 1 further comprising:

a fifth flap foldably attached to one of the panels at a second one of the minor ends having a first slot and a second slot formed therein;

a sixth flap foldably attached to one of the panels at the second minor end having a first slot and a second slot formed therein, the sixth flap substantially opposing the fifth flap;

a seventh flap foldably attached to one of the panels at the second minor end having a pair of tabs engaging the first slots of the fifth and sixth flaps in a closed configuration; and an eight flap foldably attached to one of the panels at the second minor end and opposing the seventh flap, the eight flap having a pair of tabs engaging the second slots of the fifth and sixth flaps in the closed configuration.

10. The minor-end loading carton of claim 9, wherein the first and second slots of the fifth and sixth flaps are substantially L-shaped.

11. A stalk produce shipping carton comprising:

an elongate body formed by a top panel, a bottom panel opposing the top panel, a pair of opposing side panels connecting the top panel to the bottom panel, a first minor end formed by a first set of flaps foldably connected to a first end of the panels, and a second minor end opposing the first minor end formed by a second set of flaps foldably connected to a second end of the panels, each of the panels being larger than the opposing minor ends, the first minor end and second minor ends being openable and closable by respectively engaging and disengaging the first and second sets of flaps; and a plurality of stalk produce having elongate stalks stored within the body, the elongate stalks being disposed parallel to the minor ends and extending from the bottom panel to the top panel.

12. The stalk produce shipping carton of claim 11, wherein the first set of flaps include:

a first flap;

a second flap having a slot formed therein disposed substantially perpendicular to the first flap, the second flap at least partially overlapping the first flap in a closed configuration;

a third flap having a slot formed therein disposed substantially perpendicular to the first flap and opposing the second flap, the third flap at least partially overlapping the first flap in the closed configuration; and a fourth flap having a first tab engaging the slot of the second flap and a second tab engaging the slot of the third flap in the closed configuration.

13. The stalk produce shipping carton of claim 12, wherein a distal portion of the second flap overlaps a distal portion of the third flap in the closed configuration.

14. The stalk produce shipping carton of claim 12, wherein the second flap and the third flap at least partially overlap the first flap on the same side of the first flap in the closed.

15. The stalk produce shipping carton of claim 12, wherein the second flap and the third flap at least partially overlap the first flap on opposite sides of the first flap in the closed configuration.

16. The stalk produce shipping carton of claim 12, wherein the fourth flap at least partially overlaps the second flap and the third flap on an outer side of the second flap and the third flap in the closed configuration.

17. The stalk produce shipping carton of claim 12, wherein the tabs of the fourth flap each include a tab hook engaging an edge of a respective one of the slots of the second and third flaps in the closed configuration.

18. The stalk produce shipping carton of claim 17, wherein the tabs of the fourth flap are foldable with respect to the fourth flap for assisting engagement with the slots of the second and third flaps.

19. The stalk produce shipping carton of claim 17, wherein a distal portion of the fourth flap includes a pair of forward hooks, each one of the forward hooks engaging an edge of a respective one of the slots of the second and third flaps in the closed configuration.

20. The stalk produce shipping carton of claim 12, wherein the first flap is disconnected from the second, third and fourth flaps in the closed configuration.

21. The stalk produce shipping carton of claim 12, wherein the second set of flaps include:

a fifth flap having a first slot and a second slot formed therein;

a sixth flap having a first slot and a second slot formed therein, the sixth flap substantially opposing the fifth flap;

a seventh flap having a pair of tabs engaging the first slots of the fifth and sixth flaps in a closed configuration; and an eight flap opposing the seventh flap having a pair of tabs engaging the second slots of the fifth and sixth flaps in a closed configuration.

22. The stalk produce shipping carton of claim 21, wherein the first and second slots of the fifth and sixth flaps are substantially L-shaped.

23. The stalk produce shipping carton of claim 21, wherein the first set of flaps forms a carton bottom onto which the stalk produce is loaded and the second set of flaps forms an opening in an open configuration through which the stalk produce is loaded.

24. The stalk produce shipping carton of claim 11, wherein the stalk produce includes celery.

* * * * *